US010974093B2

(12) United States Patent
Wang

(10) Patent No.: US 10,974,093 B2
(45) Date of Patent: Apr. 13, 2021

(54) AUTOMATIC WEIGHT ADJUSTABLE DUMBBELL

(71) Applicant: IMPEX Fitness Inc., Pomona, CA (US)

(72) Inventor: Zhi Wang, Taiyuan (CN)

(73) Assignee: IMPEX Fitness Inc., Pomona, CA (US)

( * ) Notice: Subject to any disclaimer, the term of this patent is extended or adjusted under 35 U.S.C. 154(b) by 63 days.

(21) Appl. No.: 16/425,007

(22) Filed: May 29, 2019

(65) Prior Publication Data

US 2020/0376320 A1 Dec. 3, 2020

(51) Int. Cl.
*A63B 21/075* (2006.01)
*A63B 21/072* (2006.01)
*A63B 24/00* (2006.01)

(52) U.S. Cl.
CPC ..... *A63B 21/075* (2013.01); *A63B 21/0726* (2013.01); *A63B 24/0087* (2013.01); *A63B 2220/805* (2013.01); *A63B 2220/833* (2013.01)

(58) Field of Classification Search
CPC ..... A63B 21/072; A63B 21/075; A63B 21/00; A63B 71/06; A63B 71/00; A63B 21/00069; A63B 21/0728; A63B 21/0726; A63B 21/00065; A63B 21/00072; A63B 2071/0694; A63B 2071/0081; A63B 2220/83; A63B 2220/833; G08C 19/00; G08C 19/02; G08C 19/025; G08C 19/04; G08C 19/06; G08C 19/10; G08C 19/12; G08C 19/16; G08C 19/30; G08C 19/36; G08C 19/38
See application file for complete search history.

(56) References Cited

U.S. PATENT DOCUMENTS

| | | | | |
|---|---|---|---|---|
| 6,494,811 | B1 * | 12/2002 | Alessandri | A63B 21/0628 482/8 |
| 9,616,271 | B2 | 4/2017 | Svenberg | |
| 10,463,906 | B2 * | 11/2019 | Owusu | A63B 21/0724 |
| 2006/0025287 | A1 * | 2/2006 | Chermack | A63B 21/075 482/107 |

* cited by examiner

*Primary Examiner* — Nyca T Nguyen
*Assistant Examiner* — Andrew M Kobylarz
(74) *Attorney, Agent, or Firm* — Chen Yoshimura LLP

(57) ABSTRACT

A dumbbell with a weight adjusting mechanism, which utilizes an electric motor, a rack and pinion gear linkage driven by the motor, and photoelectric position detection assemblies, to control the movement of two racks inside the handle bar of the dumbbell. The two racks move simultaneously in opposite directions by the same distance in a precisely controlled manner based on position signals provided by the position detection assemblies. The racks extend and retract within a center channel formed by center openings of a plurality of aligned and axially engaged weight plates, so that a desired number of the weight plates will be lifted by the dumbbell handle. A control system controls the motor and communicates with a user via a user interface panel on the handle bar or an external handheld device wireless connected to the control system.

20 Claims, 10 Drawing Sheets

AUTOMATIC WEIGHT ADJUSTABLE DUMBBELL

BACKGROUND OF THE INVENTION

Field of the Invention

This invention relates to a dumbbell, and in particular, it relates to a dumbbell with a structure to adjust the weights.

Description of Related Art

Weight apparatus such as dumbbells with a mechanical weight adjustment structure have been described. For example, U.S. Pat. No. 9,616,271 describes a weight apparatus including weight adjustment arrangement. "[The] weight apparatus includes a bar including a handle, an anchorage rotatably mounted to an end of the handle, the handle and the anchorage having an axially extending opening, a pinion gear rotatably mounted in the axially extending opening, a rod slidably disposed inside the axially extending opening and having a rack arranged to be moved axially relative to the axially extending opening upon rotation of the pinion gear, and a gear drive arrangement for rotating the pinion gear upon rotation of the handle relative to the anchorage." (Abstract.)

SUMMARY

The present invention is directed to a weight apparatus with a weight adjustment structure that is easy to use and safe.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve the above objects, the present invention provides a weight adjustment device for a weight apparatus, which includes: a mounting tube having an interior channel; a rack and pinion structure disposed at least partially within the interior channel of the mounting tube, including a first rack and a second rack coupled to each other by a coupling pinion, the coupling pinion having a fixed rotation axis relative to the mounting tube; a drive structure including an electric motor and a transmission structure, operatively engaged with the first rack to drive the first rack to move along an axial direction of the mounting tube, wherein the rack coupling pinion transmits a movement of the first rack to a movement of the second rack of a same amount and in an opposite direction as the movement of the first rack; a position detection device configured to detect positions of the rack and pinion structure and to generate position signals; a controller electrically coupled to the electric motor and the position detection device, configured to receive a weight adjustment command and to control the electric motor based on the weight adjustment command and the position signals; and an exterior housing configured to accommodate the mounting tube, the rack and pinion structure, the electric motor, the position detection device and the controller, the exterior housing having a center opening on each side which are aligned with the interior channel of the mounting tube.

It is to be understood that both the foregoing general description and the following detailed description are exemplary and explanatory and are intended to provide further explanation of the invention as claimed.

DETAILED DESCRIPTION OF PREFERRED EMBODIMENTS

Embodiments of the invention provides a dumbbell with a weight adjusting mechanism, which utilizes an electric motor, a rack and pinion gear linkage, and photoelectric position detection assemblies to control the movement of two racks inside the handle bar of the dumbbell, so that the two racks can move simultaneously toward or away from each other by the same distance and can be positioned precisely. The racks extend out of the dumbbell handle, and extend and retract within a center channel formed by the center openings of a plurality of aligned and axially engaged weight plates, so that a desired number of the weight plates are lifted when the dumbbell handle is lifted. The photoelectric position detection assemblies provide position signals that enable precise control of the extended lengths of the racks to control the number of weight plates that will be lifted. The control system of the weight adjusting mechanism allows the user to use a user interface panel on the handle bar, or an external handheld device wireless connected to the control system, to control the electric motor to achieve weight adjustment.

Although the weight adjustment structure is described here with respect to a dumbbell, it can be used in other types of weight apparatuses such as barbells, weights used in exercise machines, etc.

Figure 1:
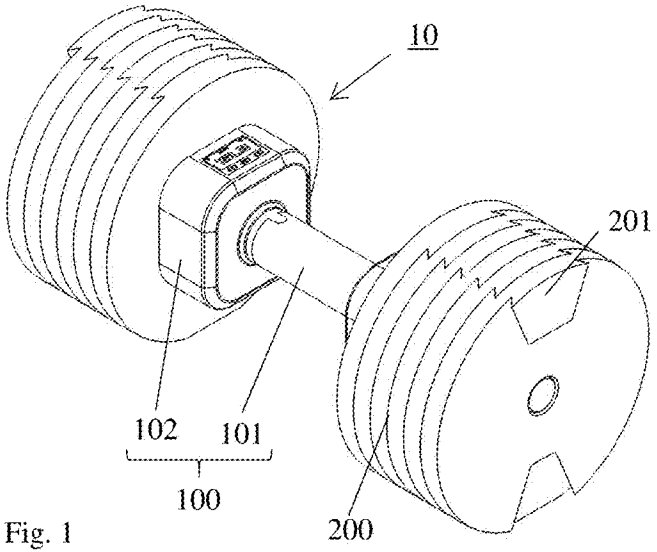
FIGS. 1 and 2 show a dumbbell according to an embodiment of the present invention.
Figure 2:
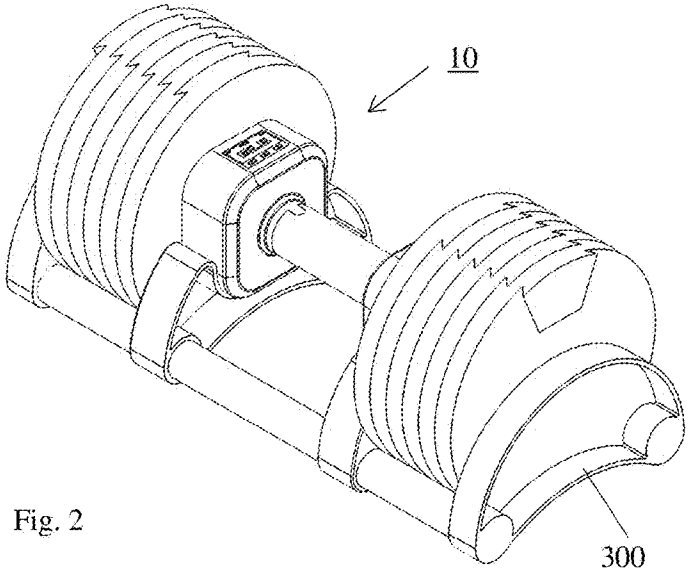

FIG. 1 shows a dumbbell 10 which includes a handle bar 100 and weight plates 200 mounted on the handle bar at two ends. The handle bar 100 includes a bar unit 101 and two end units 102 located at both ends of the bar unit. FIG. 2 shows the dumbbell 10 resting on a support base 300. The weight plates 200 are joined to each other by dovetail connector structures 201 which are formed by male and female portions on adjacent weight plates that engage each other.

Figure 3:
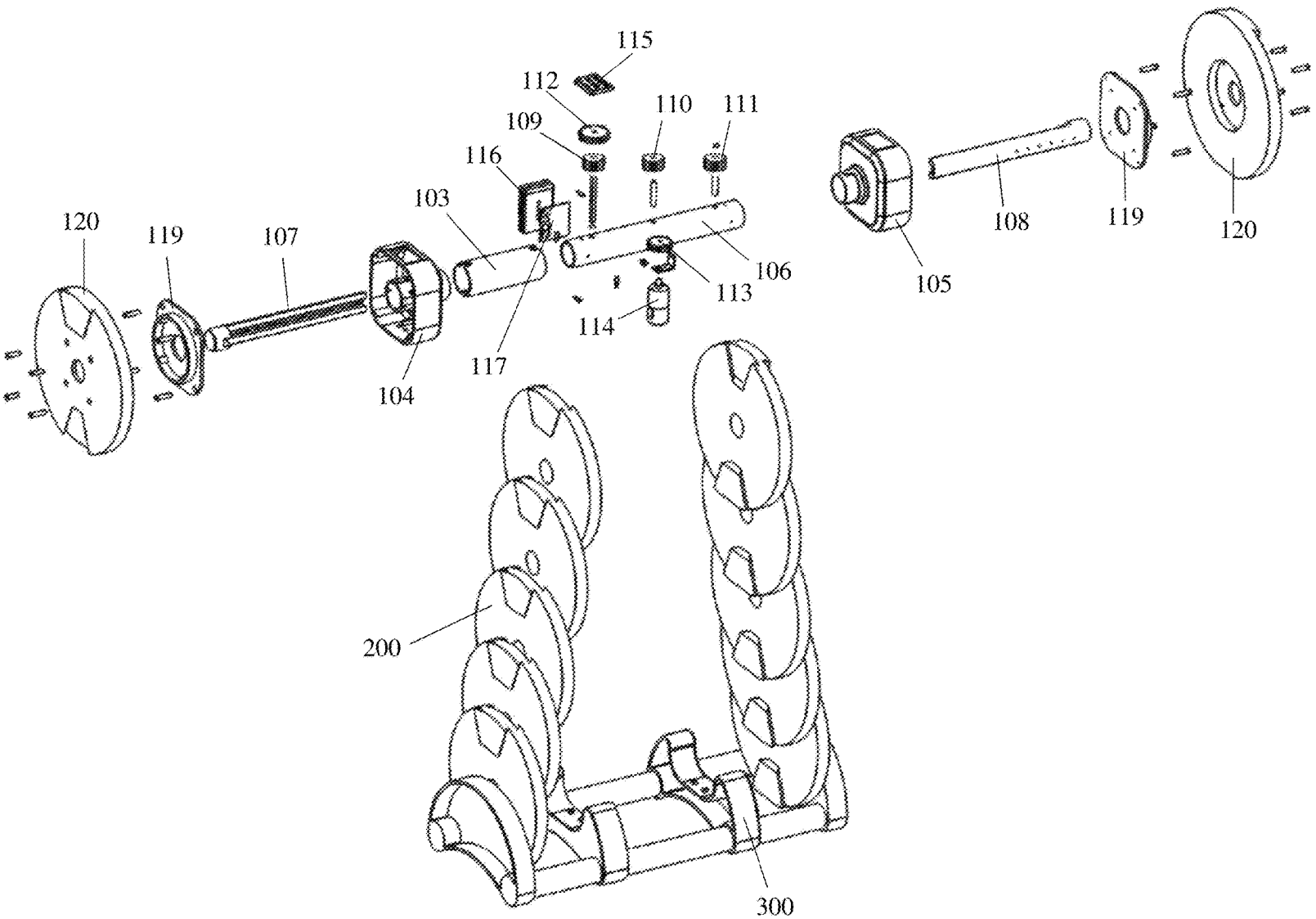
FIGS. 3 and 3A are exploded views showing components of the handle bar of the dumbbell.
Figure 3A:
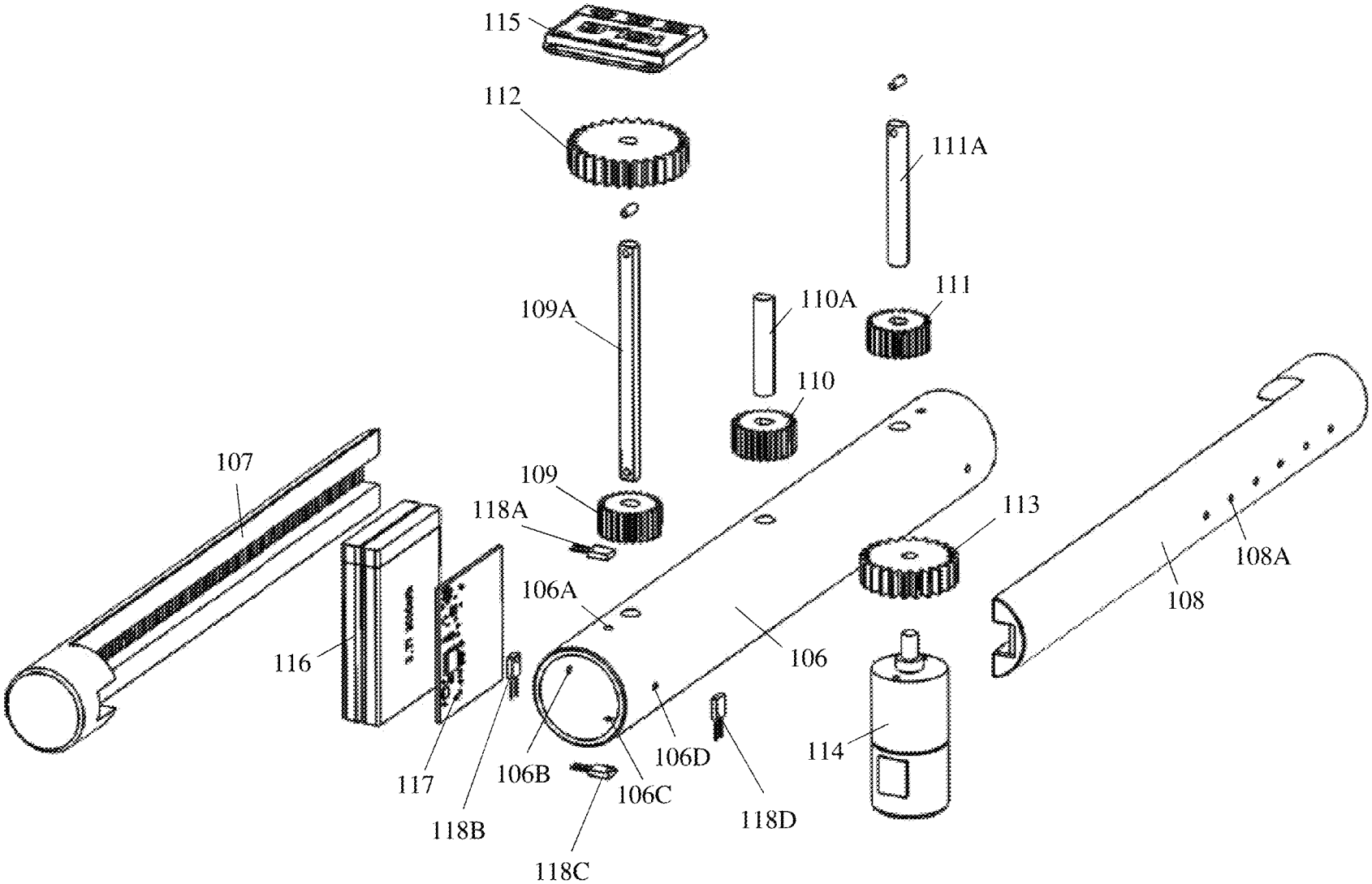
Figure 4:
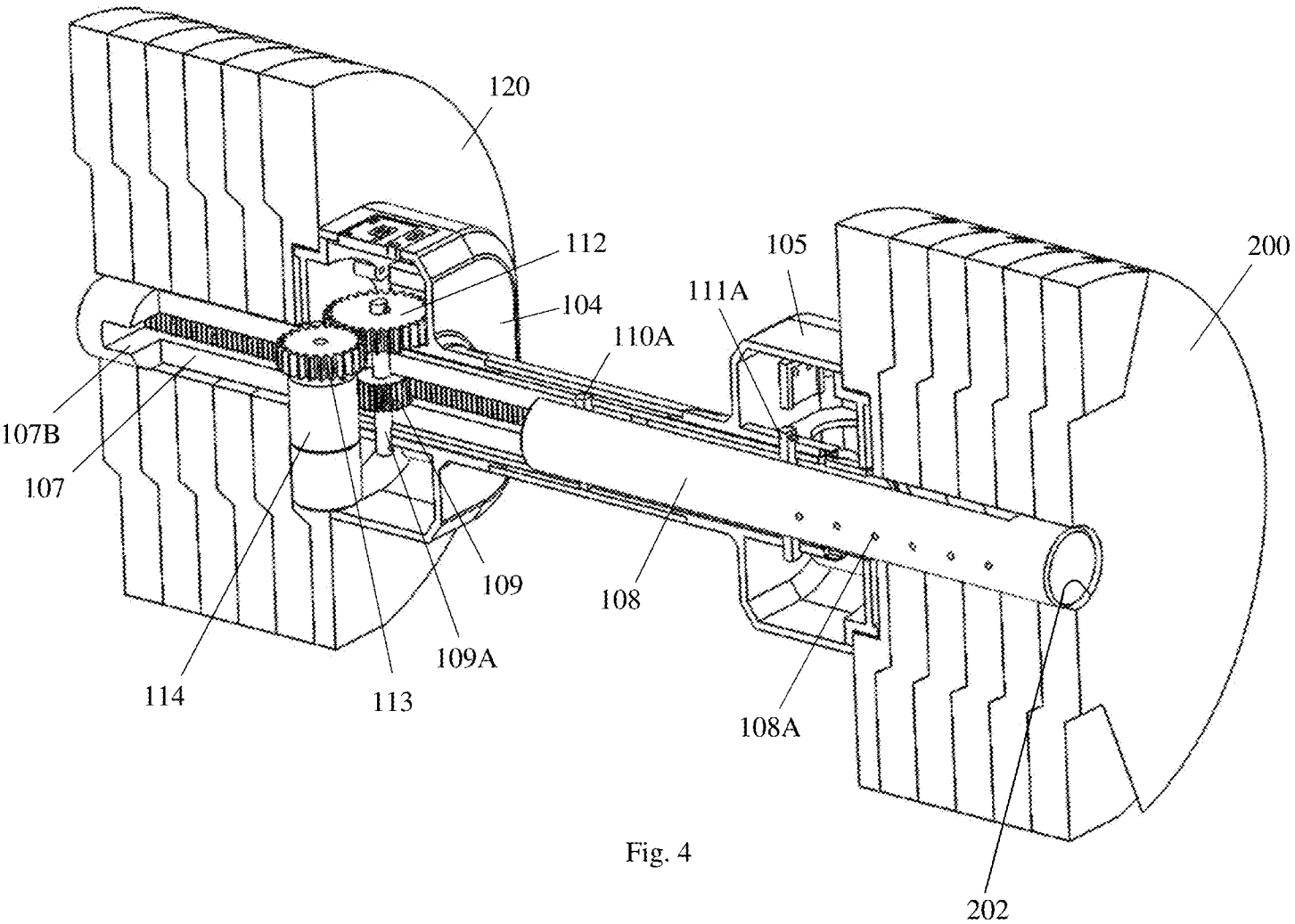
FIG. 4 is a perspective partial cut-away view showing the internal structure of the handle bar.
Figure 5:
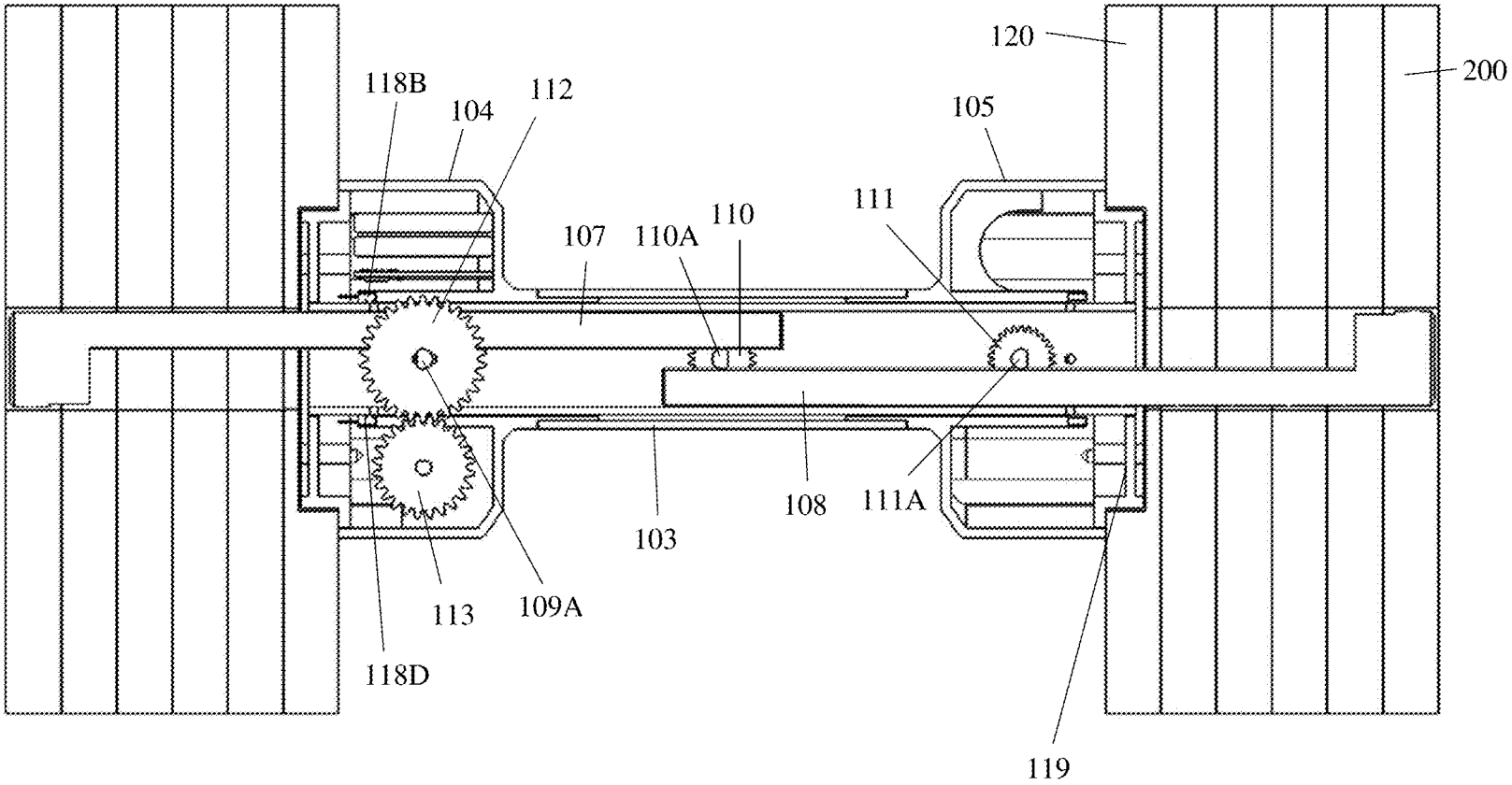
FIG. 5 is top partial cut-away view showing the internal structure of the handle bar.
Figure 6:
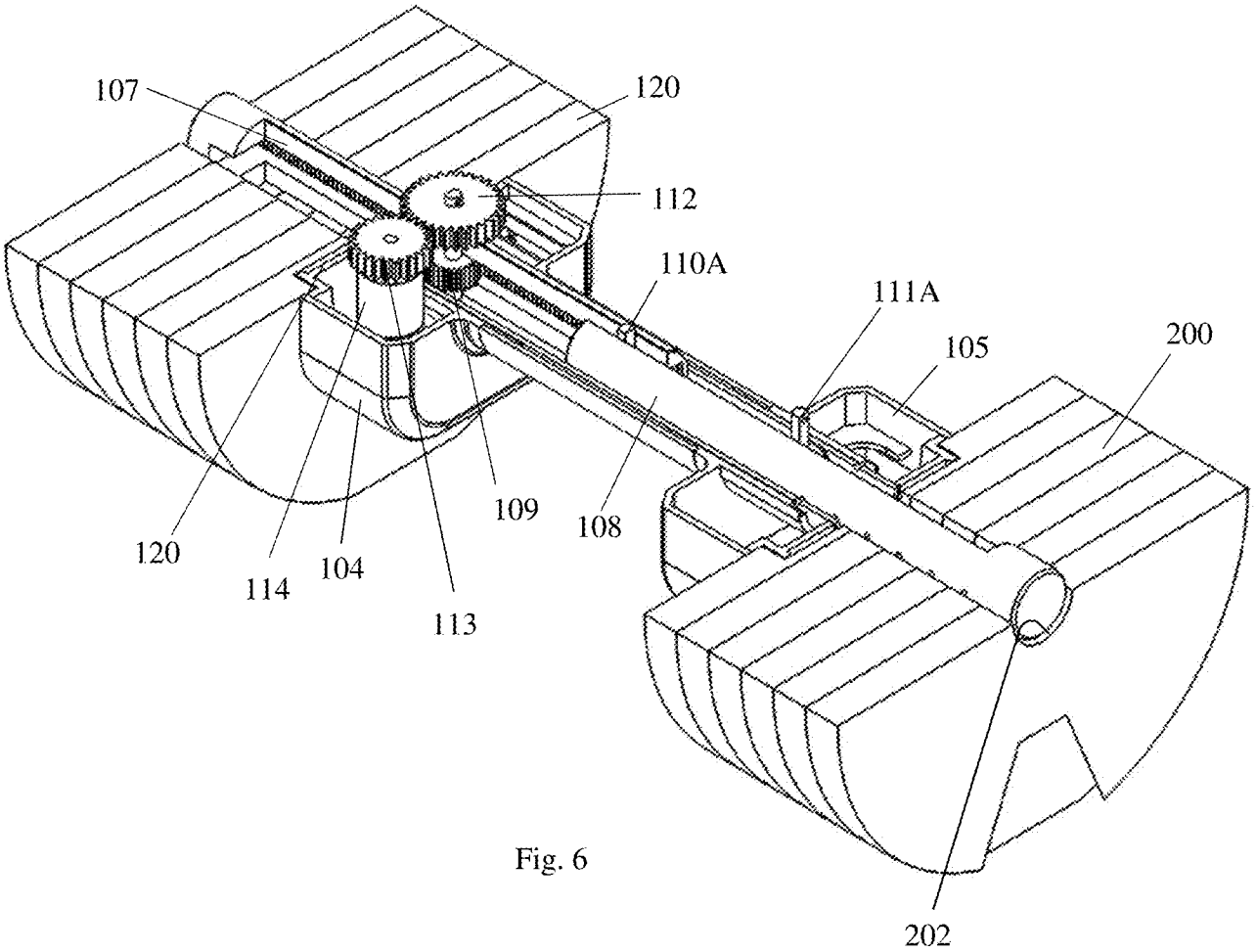
FIGS. 6 and 7 are perspective partial cut-away views showing the internal structure of the handle bar.
Figure 7:
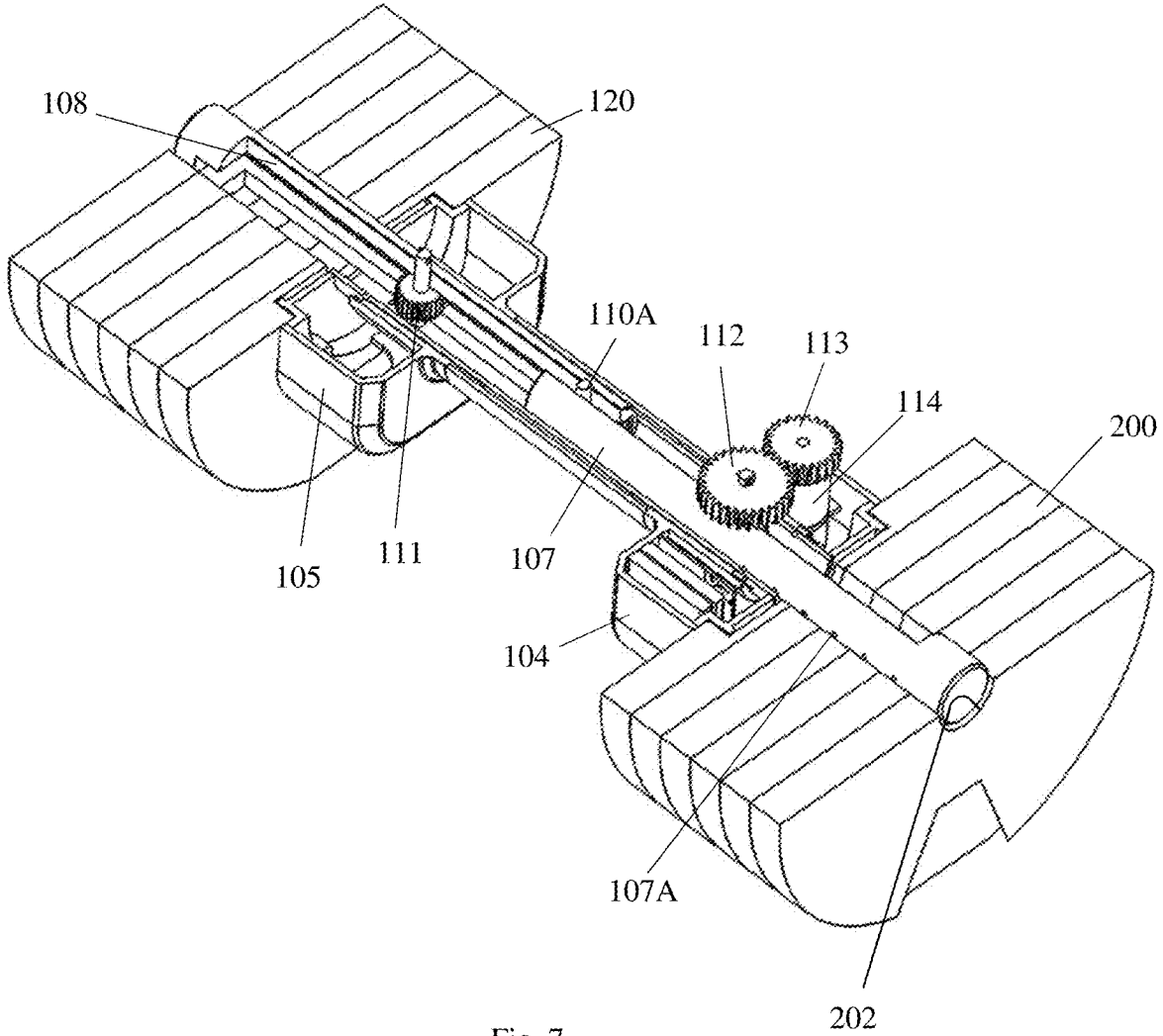

FIGS. 3 and 3A are exploded views showing various components of the handle bar 100. FIGS. 4, 6 and 7 are perspective partial cut-away views showing the internal structure of the handle bar 100. FIG. 5 is top partial cut-away view showing the internal structure of the handle bar 100.

Figure 9:
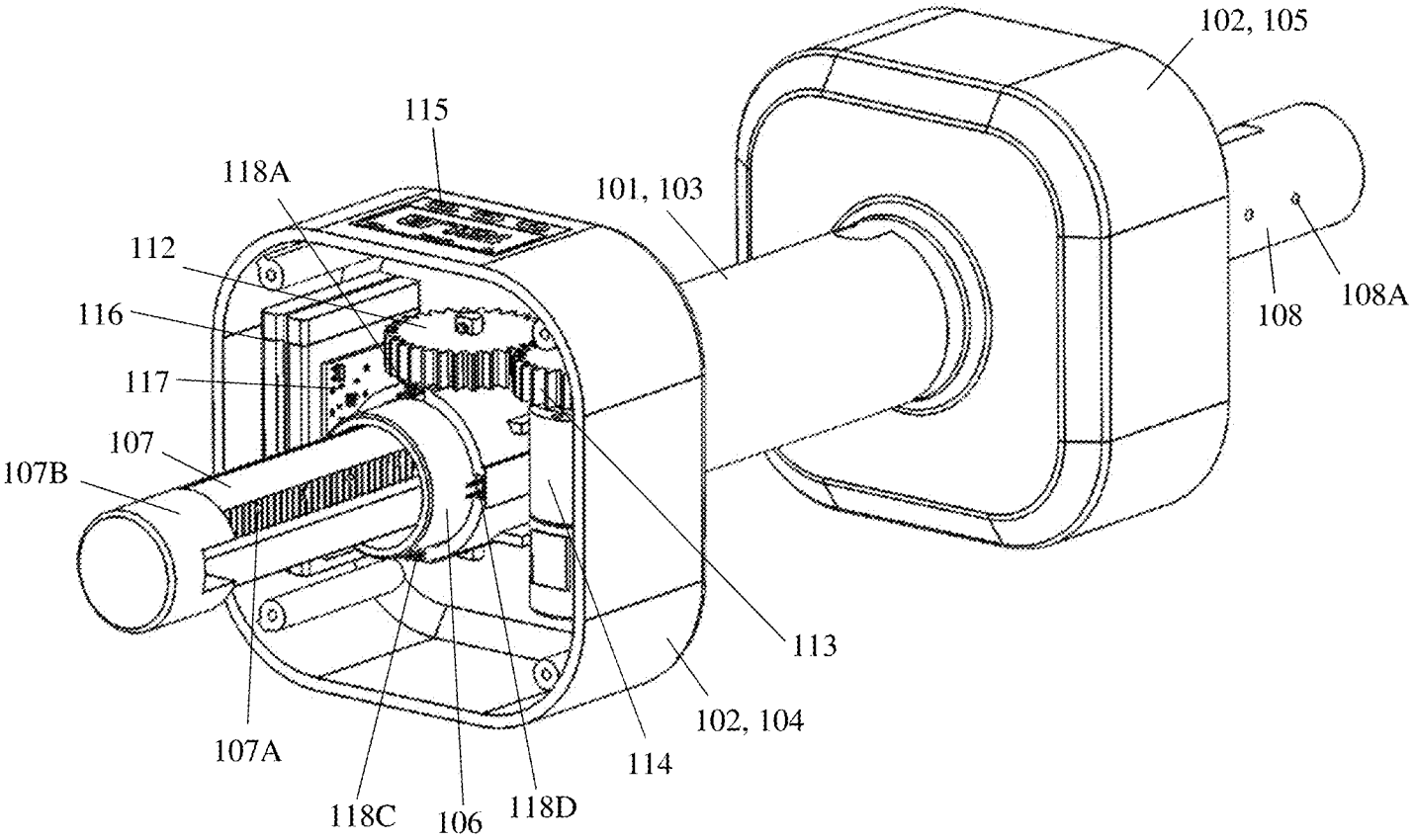
FIGS. 9 and 10 are perspective partial cut-away views showing components within one of the end units of the dumbbell.
Figure 10:
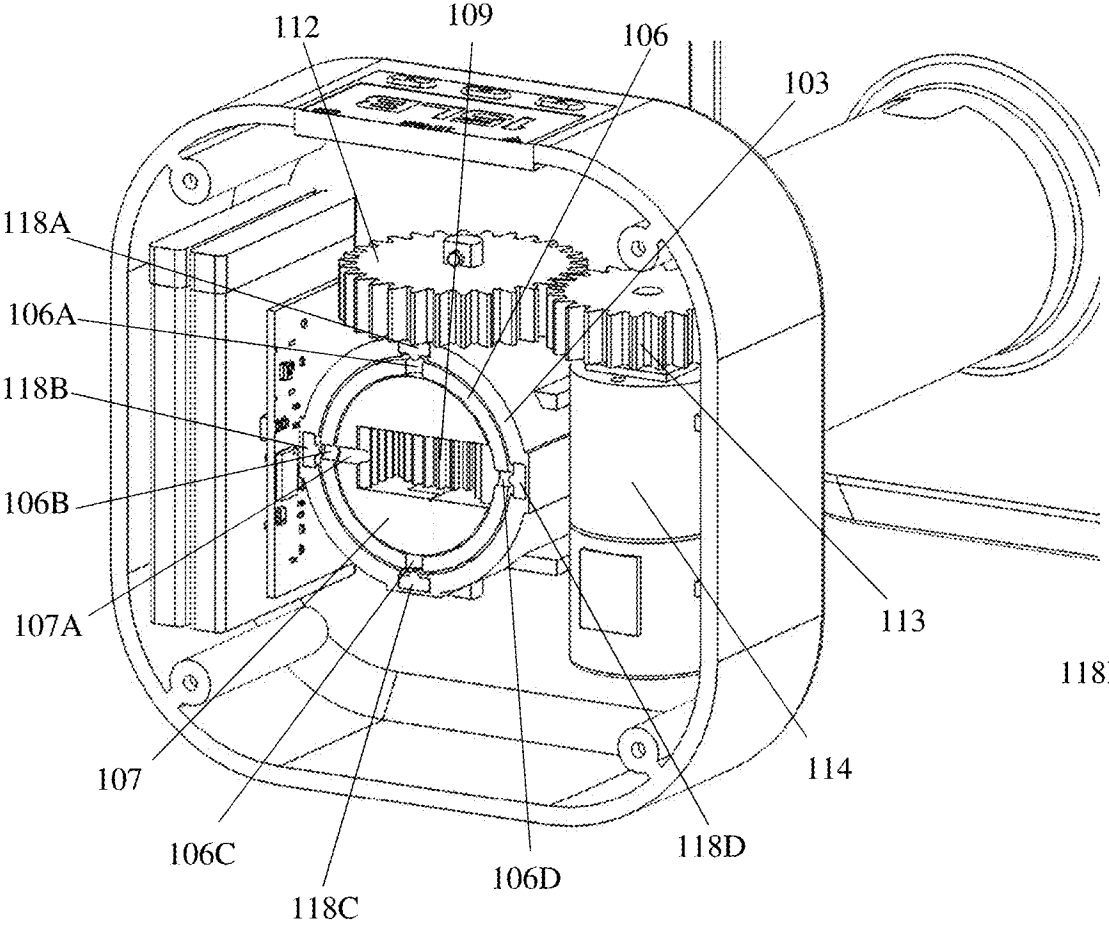

FIGS. 9 and 10 are perspective partial cut-away views showing the components within one of the end units 102.

As shown in FIGS. 4-7, the bar unit 101 has a cylindrical cover 103 and a cylindrical mounting tube 106 inside the cover. Mounted within the mounting tube 106 is a rack and pinion gear linkage mechanism, formed by two racks 107 and 108 coupled to each other by a rack coupling pinion 110. The rack coupling pinion 110 is engaged with the racks 107 and 108 and rotates around a fixed rotation shaft 110A located at the geometric center of the bar unit 101. An electric motor 114 drives the first rack 107 via drive gears 113, 112 and a drive pinion 109. More specifically, gear 113 is fixed to the rotating shaft of the motor 114 and drives gear 112; the drive pinion 109 is fixed on the same rotating shaft 109A as gear 112 and rotates with gear 112, and the drive pinion 109 meshes with the rack 107 to drive the first rack 107. A third pinion 111 with shaft 111A is located along the second rack 108 and functions to maintain its position. The shafts 109A, 110A and 111A are supported by three pairs of holes on the mounting tube 106.

As the first rack 107 moves in a translation motion in the axial direction of the mounting tube 106, the rack coupling pinion 110 drives the second rack 108 to move in a translation motion by the same amount in the opposite direction as the first rack 107. As a result, the locations and movements of the racks 107 and 108 are symmetrical with respect to the center of the bar unit 101 (the shaft 110A of pinion 110). The motor 114 can drive the racks 107 and 108 to move away from each other to assume a more extended configuration, or toward each other to assume a less extended configuration.

The motor 114, drive gears 113 and 112, and drive pinion 109 are located inside one of the end units 102 and within a cover 104. As shown in FIG. 9, also disposed within this end unit are a control circuit board 117 and a rechargeable battery 116. A user interface panel 115 is disposed on the outside of the end unit cover 104. The motor 114, battery 116, circuit board 117, and user interface panel 115 are electrically coupled to each other and their functions will be described in more detail later.

The other end unit 102, with cover 105, is located at the other end of the bar unit 101 at a symmetrical position as the first end unit with cover 104. Each end unit 102 also includes an end cover 119 to cover its distal side (i.e. the side that faces away from the bar unit 101), with a center opening to allow passage of the racks. The handle bar cover 103, the end unit covers 104 and 105, and the end cover 119 are joined to each other to form the exterior housing of the handle bar 100. An end plate 120 is affixed to the distal side of the end unit 102; the end plate has the same or similar shape as the weight plate 200, and has the dovetail connection mechanism that can join it to the adjacent weight plate.

As shown in FIGS. 4-7, the end plate 120 and each weight plate 200 has a center through hole 202. When the weight plates are aligned and joined together by the dovetail connections 201, the center through holes 202 are aligned with the interior channel of the mounting tube 106. The shape of each rack 107, 108 is a round cylinder truncated by a flat plane parallel to its axis; the flat sides of the two racks face each other and have teeth. Together the racks 107 and 108, with the space between them, fit in the round interior channel of the mounting tube 106, and fit in the center through holes 202 of the aligned weight plates 200 when the racks 107 and 108 are extended.

Figure 8:
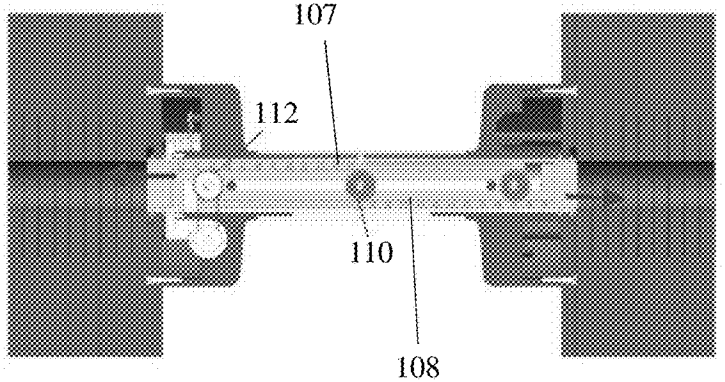
FIG. 8 is a top partial cut-away view showing the retracted (upper illustration) and the most extended (lower illustration) configurations of the rack and pinion gear linkage in the handle bar.
Figure 8:
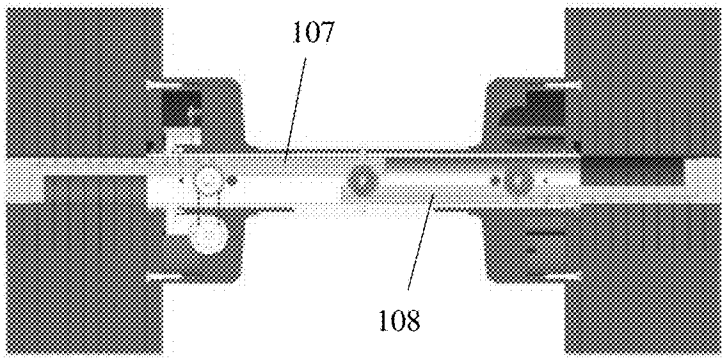

FIG. 8 shows the retracted (upper illustration) and the most extended (lower illustration) configurations of the racks 107 and 108. At the retracted position (the zero position), the distal ends of racks 107 and 108 are flush with or slightly recessed from the distal surface of the end plate 120. The racks 107 and 108 can be driven by motor 114 to extend from this zero position to desired axial positions within the channel formed by the center through holes 202 of the weight plates 200, so as to engage a desired number of weight plates. As described earlier, due to the action of the rack coupling pinion 110, the locations and movements of the racks 107 and 108 are symmetrical with respect to the center of the bar unit 101. This ensures that the same number of weight plates 200 on both sides are engaged.

Further, the dovetail connection 201 between adjacent weight plates 200 is shaped in a way such that when a weight plate closer to the handle bar 100 is lifted, the dovetail connection 201 does not lift the adjacent weight plate located farther away from the handle bar. Therefore, only weight plates 200 that are engaged by the racks 107 and 108 in the center through hole 202 will be lifted. This accomplishes the adjustment of the weight of the dumbbell 10.

In the embodiment shown in FIGS. 1 and 3A, the dovetail connection 201 provides a male part on the weight plate closer to the handle bar and a corresponding female part on the weight plate farther away from the handle bar, and the male part and the female part have a tapered shape wider at the top than at the bottom. The dovetail connection 201 additionally provides a female part on the weight plate closer to the handle bar and a corresponding male part on the weight plate farther away from the handle bar, and the male part and the female part have a tapered shape narrow at the top than at the bottom.

The handle bar 100 is further provided with photoelectric detection assemblies which cooperate with the racks 107 and 108 to detect the axial position of the racks. One photoelectric detection assembly is provided in each of the end units 102. The photoelectric detection assembly corresponding to the first rack 107 is described below; the photoelectric detection assembly corresponding to the second rack 108 have the same structures and functions.

Figure 11:
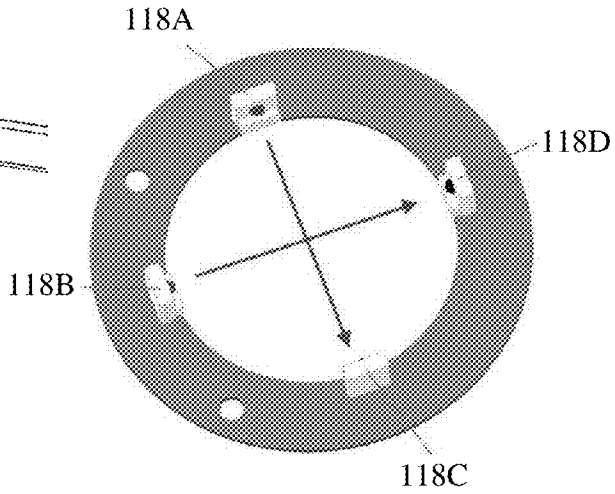
FIG. 11 shows a photoelectric detection assembly of the dumbbell.

As shown in FIGS. 3A, 5, 9 and 10, the photoelectric detection assembly includes first light emitter 118A, second light emitter 118B, first photodetector 118C, and second photodetector 118D, disposed around the mounting tube 106 near its end, and located with the end unit covered by cover 104. FIG. 11 shows the light emitters and detectors 118A-D being mounted on a mounting plate. The mounting tube 106 has four through holes 106A-D near its end which correspond in position to the light emitters/detectors 118A-D, respectively. The first light emitter 118A and first photodetector 118C face each other in a vertical radial direction of the mounting tube 106, and the second light emitter 118B and second photodetector 118D face each other in a horizontal radial direction of the mounting tube 106. Preferably, the first light emitter-detector pair 118A and 118C and the second light emitter-detector pair 118B and 118D are located on the same plane perpendicular to the axis of the mounting tube 106.

The light emitted by the light emitters and detected by the detectors may be infrared light, visible light, etc.

The second pair of light emitter-detector 118B and 118D cooperate with a row of through holes 107A on the first rack 107 to detect a series of positions of the first rack 107. Each through hole extends through the rack and is oriented horizontally in a radial direction of the rack, and the through holes are spaced apart in the axial direction of the rack. When the rack 107 moves, the through holes sequentially align with the through hole 106B on the mounting tube 106, so that a light path is formed from the second light emitting device 118B to the second photodetector 118D. The distances between adjacent through holes 107A are the same as the thickness of the weight plates 200, and the axial positions of the through holes are such that when a though hole is aligned with the through hole 106B, the distal end of the rack 107 is flush with the distal surface of a weight plate 200. Thus, the first light emitter and detector generates position signals when the rack 107 is located at a series of indexed positions. The second rack 108 similarly has through holes 108A serving similar functions.

The first pair of light emitter-detector 118A and 118C operates detect the zero position of the first rack 107. The light path between the first light emitter 118A and the first photodetector 118C is along the vertical radial direction of the mounting tube 106, and is normally unobstructed by the first rack 107 as the cross-sectional shape of the first rack 107 is less than half of the circle defined by the mounting tube 106. As the distal end of the first rack 107, however, a head block 107B is provided (see FIGS. 9 and 4), which is shaped to block the vertical light path when the rack 107 is at or near the zero (retracted) position. In FIG. 10, a cross section of the head block 107B is seen blocking the vertical light path of the first light emitter-detector 118A and 118C.

Thus, at the zero position, as shown in FIG. 10, the first pair of light emitter-detector 118A and 118C is blocked by the head block and does not detect a light signal, while the first through hoe 107A on the first rack 107 is aligned with the through hole 106B of the mounting tube 106 so the second pair of light emitter-detector 118B and 118D detects a light signal. This combination of detected signals indicates a zero position where no weight plate 200 is engaged by the handle bar 100.

As the rack 107 is driven by the motor 114 to extend from the zero position, the head block 107B moves out of the light path of the first pair of light emitter-detector 118A and 118C so the first pair of light emitter-detector detects a light signal; meanwhile, the second pair of light emitter-detector 118B and 118D does not detect a light signal until the second through hole 107A is aligned with the through hole 106B of the mounting tube 106. This condition indicates that one weight plate 200 on each side is engaged by the handle bar 100. As the motor drives the tack to extend further, a third through hole on the rack 107 will come into alignment with the through hole 106B of the mounting tube 106, indicating that one more weight plate on each side is now engaged. A controller on the circuit board 117 controls the motor 114 to drive the racks, and uses the detected light signals from the photoelectric detection assemblies as a feedback signal. The retraction motion of the racks are controlled similarly. This way, the controller can control the motor to drive the racks to desired positions to engage desired numbers of weight plates. The controller may be implemented in logic circuits, a microprocessor with associated memory, etc.

Figure 12:
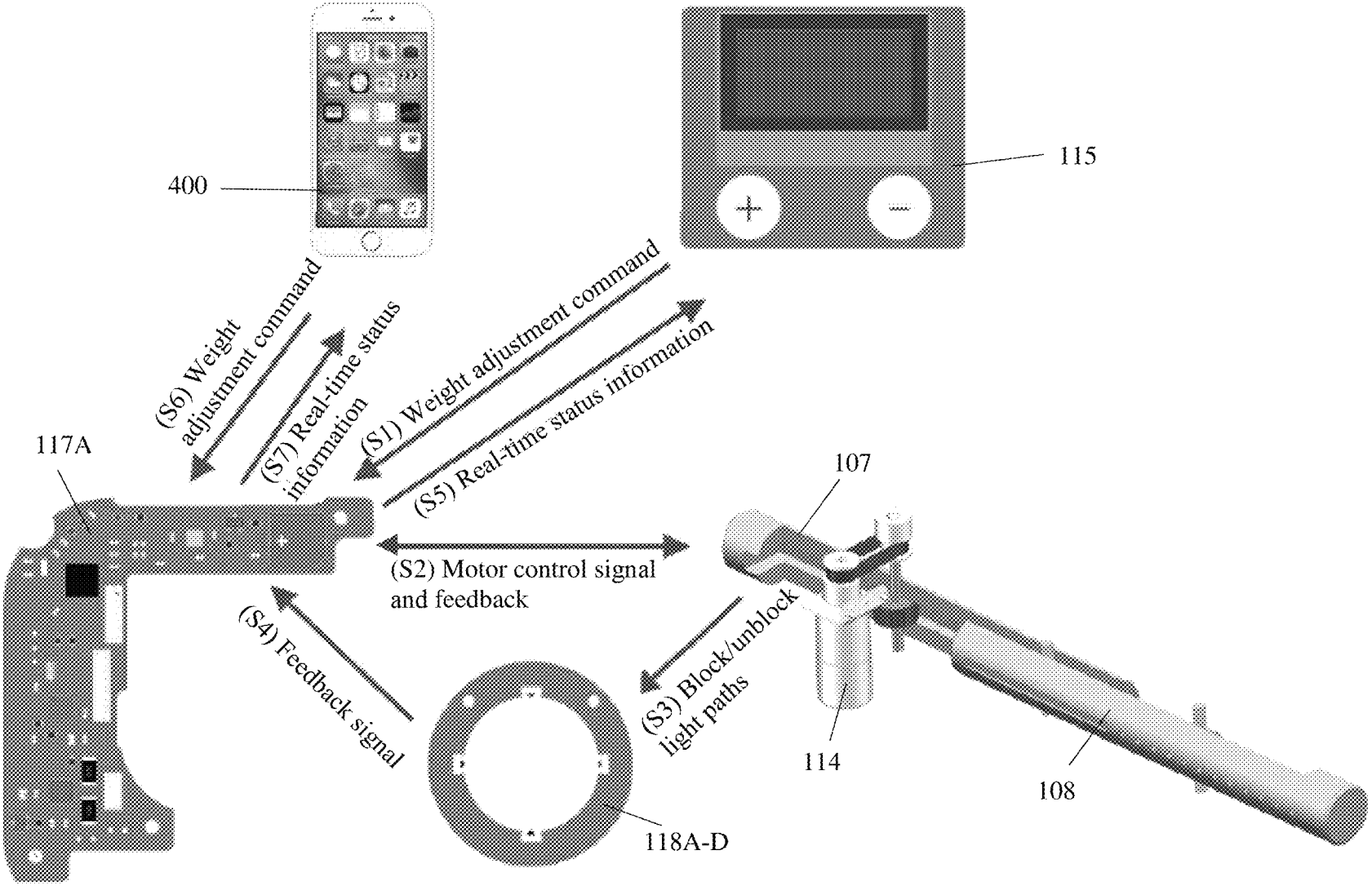
FIG. 12 illustrates operations of the dumbbell.

The operation of the dumbbell 10 is described below with reference to FIG. 12. The user can use the user interface panel 115 on the dumbbell 10, which has a display screen and input tools (such as press buttons, touch screen, etc.), to manually send weight adjustment commands to the controller 117A on the circuit board 117 to set, increase, or decrease the number of weight plates to be engaged (operation S1). Based on the command, the controller 117A sends control signals to the motor 114 to drive the racks 107 and 108 (operation S2). In one embodiment, the motor is a stepping motor, and the controller calculates the rotation amount of the motor based on the weigh adjustment commands and parameters of the mechanical structure of the various gears and the racks, and sends pulse signals to the stepping motor. As the racks 107 and 108 are driven by the motor 114, the light paths of the photoelectric detection assemblies are blocked or unblocked by the racks (operation S3). Accordingly, the photoelectric detection assemblies generate feedback signals to the controller (operation S4). As described earlier, the feedback signals from the photoelectric detection assemblies indicates whether the through holes on the racks are located at desired positions. Moreover, the stepping motor also sends a feedback signal to the controller to indicate that it has completed the requested amount of rotation (operation S2). Based on the feedback signals from the photoelectric detection assemblies and the motor, the controller can determine whether that the desired weight adjustment has been achieved. If, for example, the feedback signal from the motor indicates that the requested rotation has been executed, but the feedback signals from the photoelectric detection assemblies indicates that the racks are not yet at the desired position or has overshot (e.g., no light signal detected by the second photodetector 118D), the controller can send further control signals to the motor to correct its movement. The controller can send information regarding the real-time status of the dumbbell (e.g. the weight being engaged, a confirmation signal, etc.) to the user interface panel 115 to be displayed (operation S5).

In an alternative embodiment, the controller controls the motor in a closed-loop manner, where it continuously sends a drive signal to the motor while monitoring the feedback signal form the photoelectric detection assemblies to determine whether the desired position is reached.

Additionally, the circuit board 117 may include a wireless communication interface, such as a Bluetooth interface, to allow the controller to communicate with an external handheld device such as a smart phone 400. The user may use an app on the handheld device to issue weight adjustment commands to the controller, to set, increase, or decrease the number of weight plates to be engaged (operation S6), and the controller sends real-time status information back to the handheld device for display (operation S7).

In one embodiment, a Hall sensor is provided on the circuit board 117 and electrically coupled to the controller, while a magnet is provided on the support base 300 at a corresponding location. The controller is configured to control the motor to perform the weight adjustment operation only when the Hall sensor detects a requisite magnetic field, indicating that the dumbbell 10 is set on the support base 300. This prevents accidental operation when the dumbbell 10 is not on the support base 300.

In addition, a charging connection is provided on the support base 300 and the handle bar 100 to charge the battery 116 when the dumbbell 10 is set on the support base 300.

It will be apparent to those skilled in the art that various modification and variations can be made in the automatic weight adjustable dumbbell and its operation method of the present invention without departing from the spirit or scope of the invention.

For example, in some alternative embodiments, in lieu of the drive gears 112 and 113, alternative structures may be used to transmit the rotation of the motor to the drive pinion 109. For example, the motor 114 may drive the drive pinion 109 directly, or via a belt and pulley system, etc. It is also possible to provide an additional line of teeth on the first rack 107 and for the motor to drive the first rack by engaging with these additional teeth. More generally, any transmission structure that transmits the rotation of the motor to the first rack 107 may be employed. The transmission structure and the motor may be collectively referred to as a drive structure for driving the first rack 107.

In some alternative embodiments, while the handle bar cover 103 is a round cylinder, the mounting tube 106 may have a square, rectangular, or other non-round cross section. The cross-sectional shape of the first and second racks 107 and 108 may also be non-round.

The user interface panel 115 and/or battery 116 and/or circuit board 117 may alternatively be disposed in or on the second end unit 102 with the cover 105.

In some other alternative embodiments, the angular positions (the positions around the axis of the mounting tube 106) of the light emitters and detectors may be different from those shown in FIGS. 9-11, and the through holes in the racks and the head blocks are positioned and oriented accordingly, so that they achieve the blocking and unblocking of the light paths in the desired manner described earlier. The first rack may alternatively be shaped such that it blocks the light path between the first light emitter and the first photodetector continuously except when the rack is in the retracted position. The photoelectric detection assemblies may alternatively be provided at other locations, such as within the handle bar rather than in the end units. Also, the photoelectric detection assembly may be provided for only one of the two racks.

Moreover, in lieu of the light emitters and detectors described above, other position detection devices may be used to detect the position of the first and second racks, such as position encoders employing optical or magnetic signals, etc. The position detection device may also be a part of the motor or the transmission structure between the motor and the first rack to detect their position, which indirectly detects the position of the racks.

Thus, it is intended that the present invention cover modifications and variations that come within the scope of the appended claims and their equivalents.

What is claimed is:

1. A weight adjustment device for a weight apparatus, comprising:

a mounting tube having an interior channel;

a rack and pinion structure disposed at least partially within the interior channel of the mounting tube, including a first rack and a second rack coupled to each other by a coupling pinion;

a drive structure including an electric motor and a transmission structure, operatively engaged with the rack and pinion structure to drive the first rack and the second rack to move along an axial direction of the mounting tube along opposite directions by same amounts;

a position detection device configured to detect at least a position of one of the first rack and second rack along the axial direction of the mounting tube and to generate position signals;

a controller electrically coupled to the electric motor and the position detection device, configured to receive a weight adjustment command and to control the electric motor based on the weight adjustment command and the position signals; and an exterior housing configured to accommodate the mounting tube, the rack and pinion structure, the electric motor, the position detection device and the controller, the exterior housing having a center opening on each side which are aligned with the interior channel of the mounting tube.

2. The weight adjustment device of claim 1, wherein the position detection device includes a first light emitter and a first photodetector facing each other and positioned on opposite sides of the first rack, and wherein the first rack has a plurality of through holes configured to sequentially align with a light path between the first light emitter and the first photodetector as the first rack moves along the axial direction.

3. The weight adjustment device of claim 2, wherein the position detection device further includes a second light emitter and a second photodetector facing each other, and wherein the first rack is configured to block a light path between the second light emitter and the second photodetector only when the rack and pinion structure is in a retracted configuration.

4. The weight adjustment device of claim 3, wherein the first and second light emitters and the first and second photodetectors are disposed outside of the mounting tube, and where the mounting tube has four through holes at locations corresponding to the first and second light emitters and the first and second photodetectors.

5. The weight adjustment device of claim 3, wherein the controller is configured to determine a retracted position of the rack and pinion structure in response to receiving a position signal indicating that the first photodetector is detecting a light emitted by the first light emitter and the second photodetector is not detecting a light emitted by the second light emitter.

6. The weight adjustment device of claim 2, wherein the plurality of through holes on the first rack are evenly spaced.

7. The weight adjustment device of claim 1, wherein the exterior housing has a handle bar cover with a round cylindrical shape and two end units respectively joined to two ends of the handle bar cover, each end unit having a center opening aligned with the interior channel of the mounting tube, wherein the mounting tube has a round shape is at least partially disposed with the handle bar cover, and wherein the electric motor, the position detection device and the controller are disposed within one or both of the end units.

8. The weight adjustment device of claim 7, further comprising two end plates respectively affixed to two distal ends of the end units, each end plate having an center opening aligned with the center opening of the end unit and a dovetail connector structure configured to engage an adjacent weight plate.

9. The weight adjustment device of claim 1, wherein the rack and pinion structure has a retracted configuration and a plurality of extended configurations, wherein in the extended configurations, the first and second racks extend outside of two ends of the exterior housing through the center openings, respectively.

10. The weight adjustment device of claim 1, wherein the drive structure includes a drive pinion engaged with the first rack and having a fixed rotation axis with respect to the mounting tube, and drive gears configured to transmit the rotation of the motor to the drive pinion.

11. The weight adjustment device of claim 1, further comprising a third pinion engaged with the second rack and having a fixed rotation axis with respect to the mounting tube.

12. The weight adjustment device of claim 1, wherein the position detection device generates position signals to indicate that the rack and pinion structure is at a retracted position or one of a plurality of indexed positions.

13. The weight adjustment device of claim 1, further comprising a user interface panel disposed on the exterior housing and electrically coupled to the controller, configured to transmit the weight adjustment command to the controller, and wherein the controller is further configured to transmit a weight adjustment status signal to the user interface panel.

14. The weight adjustment device of claim 1, further comprising a wireless communication interface configured to wirelessly receive the weight adjustment command from an external device and to transmit the weight adjustment command to the controller, and wherein the controller is further configured to transmit a weight adjustment status signal via the wireless communication interface to the external device.

15. The weight adjustment device of claim 1, further comprising a Hall sensor electrically coupled to the controller, wherein the controller is configured to control the motor to rotate only when receiving a detection signal from the Hall sensor.

16. The weight adjustment device of claim 1, wherein the coupling pinion having a fixed rotation axis relative to the mounting tube, wherein the drive structure is configured to drive the first rack to move along the axial direction of the mounting tube, and wherein the coupling pinion transmits a movement of the first rack to a movement of the second rack of a same amount and in an opposite direction as the movement of the first rack.

17. A weight adjustment device for a weight apparatus, comprising:

a mounting tube having an interior channel;

a rack and pinion structure disposed at least partially within the interior channel of the mounting tube, including a first rack and a second rack coupled to each other by a coupling pinion;

a drive structure including an electric motor and a transmission structure, operatively engaged with the rack and pinion structure to drive the first rack and the second rack to move along an axial direction of the mounting tube along opposite directions by same amounts;

a controller electrically coupled to the electric motor, configured to receive a weight adjustment command and to control the electric motor based on the weight adjustment command; and an exterior housing configured to accommodate the mounting tube, the rack and pinion structure, the electric motor, and the controller, the exterior housing having a center opening on each side which are aligned with the interior channel of the mounting tube, wherein the exterior housing has a handle bar cover with a cylindrical shape and two end units respectively joined to two ends of the handle bar cover, each end unit having a center opening aligned with the interior channel of the mounting tube, wherein the mounting tube is at least partially disposed with the handle bar cover, and wherein the electric motor, and the controller are disposed within one or both of the end units.

18. The weight adjustment device of claim 17, wherein the coupling pinion having a fixed rotation axis relative to the mounting tube, wherein the drive structure is configured to drive the first rack to move along the axial direction of the mounting tube, and wherein the coupling pinion transmits a movement of the first rack to a movement of the second rack of a same amount and in an opposite direction as the movement of the first rack.

19. The weight adjustment device of claim 17, wherein the handle bar cover has a round cylindrical shape, and the mounting tube has a round shape.

20. The weight adjustment device of claim 17, further comprising a position detection device configured to detect positions of the rack and pinion structure and to generate position signals, wherein the controller is further electrically coupled to the position detection device, and configured to control the electric motor based on both the weight adjustment command and the position signals, wherein the exterior housing is further configured to accommodate the position detection device, and wherein the position detection device is disposed within one or both of the end units.

* * * * *